United States Patent [19]

Ninomiya et al.

[11] 4,340,022

[45] Jul. 20, 1982

[54] FUEL INJECTION DEVICE OF AN INTERNAL COMBUSTION ENGINE

[75] Inventors: Masakazu Ninomiya, Kariya; Hideo Kiuchi, Hoi; Atsushi Suzuki, Kariya; Nobuyuki Kobayashi, Toyota, all of Japan

[73] Assignee: Toyota Jidosha Kogyo Kabushiki Kaisha, Aichi, Japan

[21] Appl. No.: 138,734

[22] Filed: Apr. 9, 1980

[30] Foreign Application Priority Data

Jun. 7, 1979 [JP] Japan ..... 54-71962

[51] Int. Cl.[3] ..... F02M 59/32

[52] U.S. Cl. ..... 123/453; 123/179 L

[58] Field of Search ..... 123/452, 453, 454, 455, 123/179 L, 370, 492

[56] References Cited

U.S. PATENT DOCUMENTS

| | | | |
|---|---|---|---|
| 3,494,340 | 2/1970 | Weber | 123/453 |
| 4,090,487 | 5/1978 | Stumpp | 123/452 |
| 4,216,757 | 8/1980 | Romann | 123/179 L |
| 4,257,375 | 3/1981 | Ulrich | 123/453 |

FOREIGN PATENT DOCUMENTS

| | | | |
|---|---|---|---|
| 2704456 | 8/1978 | Fed. Rep. of Germany | 123/453 |

*Primary Examiner*—Charles J. Myhre
*Assistant Examiner*—Carl Stuart Miller
*Attorney, Agent, or Firm*—Stevens, Davis, Miller & Mosher

[57] ABSTRACT

A fuel injection device comprising a fuel pump, a constant pressure valve and a fuel nozzle connected to the fuel pump via a fuel feed passage. The constant pressure chamber of the constant pressure valve is arranged in the fuel feed passage. A flow control valve is arranged in the fuel feed passage between the constant pressure chamber and the fuel nozzle. The amount of the fuel injected from the fuel nozzle is controlled by the flow control valve so as to be directly proportional to the amount of the air sucked in. The constant pressure chamber is connected to the fuel nozzle via a bypass passage. An electromagnetic valve is arranged in the bypass passage and opened when an engine is accelerated and before the completion of the warm-up of an engine.

14 Claims, 10 Drawing Figures

FUEL INJECTION DEVICE OF AN INTERNAL COMBUSTION ENGINE

DESCRIPTION OF THE INVENTION

The present invention relates to a fuel injection device having a novel construction for use in an internal combustion engine.

There has been proposed a fuel injection device of a continuous injection type, which has a metering slot and a single injection nozzle common to all the cylinders of an engine. In this fuel injection device, the amount of the fuel injected from the injection nozzle is increased proportionally to an increase in the flow area of the metering slot. This metering slot is formed in the intersecting zone of the opening of the stationary member and the opening of the rotatable member, and the rotatable member is directly driven by a rotatable controlling body arranged in the intake passage and rotated proportionally to an increase in the amount of the air sucked in.

As is known to those skilled in the art, in an internal combustion engine, it is necessary to increase an amount of the fuel injected from the injection nozzle at the time of acceleration and during the warm-up of an engine for ensuring good combustion. However, in the above-mentioned fuel injection device, it is impossible to ensure an easy start of an engine and a satisfactory good acceleration of an engine.

An object of the present invention is to provide a fuel injection device capable of ensuring an easy start of an engine and good acceleration of an engine.

According to the present invention, there is provided a fuel injection device of an internal combustion engine having an intake passage, said device comprising: a fuel reservoir; fuel pump connected to said fuel reservoir; a fuel chamber having a fuel nozzle which opens into said intake passage, a fuel feed passage connecting said fuel pump to said fuel chamber; flow control means arranged in said fuel feed passage for controlling the flow of a fuel so that the fuel is fed into said fuel chamber in an amount which is directly proportional to the amount sucked-in air flowing within said intake passage; first valve means having a constant pressure chamber arranged in said intake passage between said fuel pump and said flow control means for feeding the fuel at a constant pressure into said flow control means; detecting means for detecting an operating condition of the engine which produces a control signal when the engine is accelerated and before the completion of the warm-up of the engine; a fuel bypass passage directly connecting said constant pressure chamber to said fuel chamber, and; a normally closed second valve means arranged in said fuel bypass passage for opening said fuel bypass passage in response to said control signal when the engine is accelerated before the completion of the warm-up of the engine.

The present invention may be more fully understood from the description of preferred embodiments of the invention set forth below, together with the accompanying drawings.

DESCRIPTION OF PREFERRED EMBODIMENTS

Figure 1:
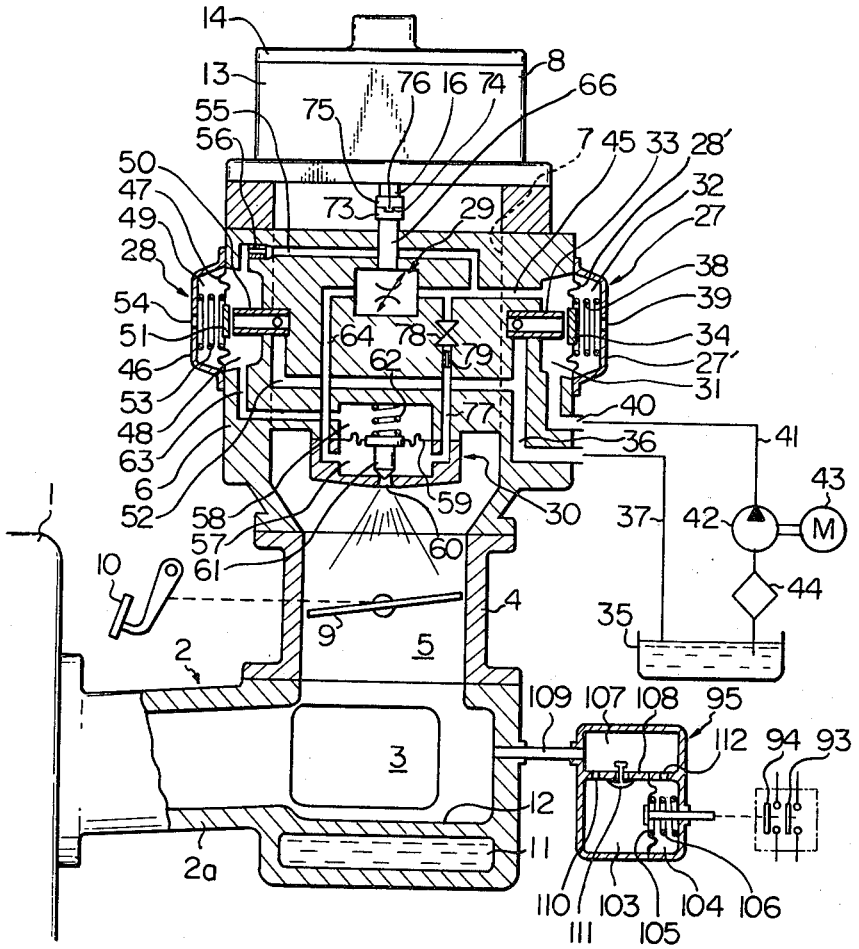
FIG. 1 is a cross-sectional side view of a fuel injection device according to the present invention.

Referring to FIG. 1, 1 designates an engine body, 2 an intake manifold fixed onto the engine body 1; 3 designates a collecting portion of the intake manifold 2, 4 a throttle duct forming an intake passage 5 therein and mounted on the intake manifold 2; 6 designates a fuel injector body mounted on the throttle duct 4 and forming therein an intake passage 7 illustrated by the broken line, and 8 designates an instrument for sucking-in a controlled amount of air. A throttle valve 9 is arranged within the intake passage 5 of the throttle duct 4 and connected to an accelerator pedal 10 arranged in the driver's compartment. As illustrated in FIG. 1, this throttle valve 9 is shaped in the form of a butterfly valve. In addition, the intake manifold 2 is made of, for example, a light alloy, and a cooling water chamber 11 is formed in the bottom wall of the collecting portion 3 for heating a riser portion 12. Ambient air is sucked into the intake passage 7 via the air cleaner (not shown) and the instrument 8 and then introduced into the collecting portion 3 via the intake passage 5. As described hereinafter in detail, fuel is injected from the fuel injector body 6 towards the throttle valve 9 and, thus, an air-fuel mixture is formed within the intake passage 5. Then, the mixture thus formed is introduced into the collecting portion 3 and heated by the riser portion 12. After this, the mixture is fed into the cylinders via corresponding manifold branches **2*a* of the intake manifold 2**.

Figure 2:
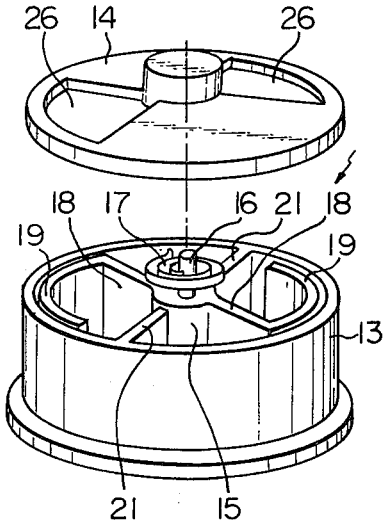
FIG. 2 is a perspective view of an apparatus for sucking-in a controlled amount of air, shown with the lid member removed.
Figure 3:
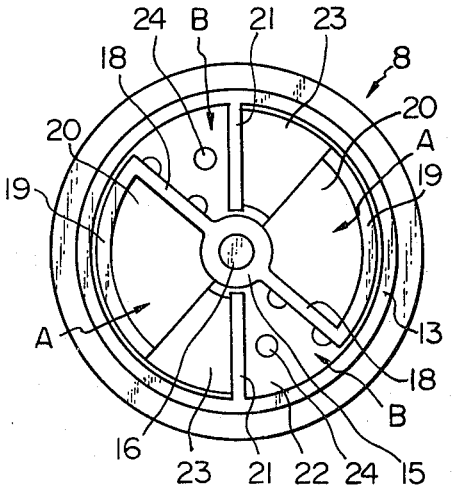
FIG. 3 is a plan view of the apparatus for sucking-in a controlled amount of air illustrated in FIG. 2, shown with the lid member removed.
Figure 4:
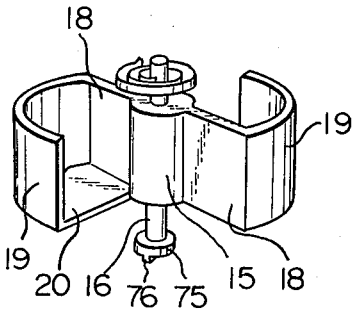
FIG. 4 is a perspective view of the body of the apparatus illustrated in FIG. 2.
Figure 5:
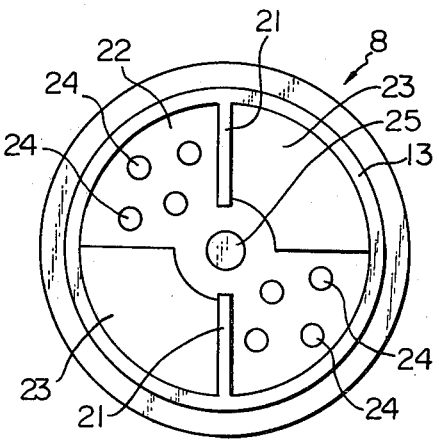
FIG. 5 is a plan view of the casing of the apparatus for sucking-in a controlled amount of air illustrated in FIG. 2, shown with the lid member and the controlling body removed.

As illustrated in FIGS. 2 through 5, the instrument 8 comprises a cylindrical casing 13, a lid member 14, and a controlling body 15. The controlling body 15 is fixed onto a rotatable shaft 16 which is rotatably supported by the casing 13 and the lid member 14, and a coil spring 17 is arranged on the top of the shaft 16. The inner end of the coil spring 17 is connected to the shaft 16, and the outer end of the coil spring 17 is connected to the inner wall of the lid member 14 so that the controlling body 15 is always biased in the counter-clockwise direction by the coil spring 17. The coil spring 17 provides an approximately constant torque to the controlling body 15, in spite of the position of the controlling body 15. The controlling body 15 comprises a pair of radially extending vertical walls 18, a pair of curved peripheral walls 19 extending along the cylindrical inner wall of the casing 13, and a pair of sector shaped bottom walls 20. As illustrated in FIGS. 3 and 5, the casing 13 comprises a pair of radially extending vertical walls 21 formed in one piece on the cylindrical inner wall of the casing 13, and a bottom plate 22. A pair of sector shaped openings 23 and a plurality of vacuum holes 24 are formed on the bottom plate 22. In addition, a center hole 25 is formed on the bottom plate 22 at its center. The shaft 16 of the controlling body 15 is inserted into the center hole 25 and, thereby, the controlling body 15 is rotatable supported by the casing 13. In addition, as illustrated in FIG. 2, the lid member 14 formed thereon a pair of sector shaped openings 26 which are arranged to be aligned with the sector shaped openings 23 formed on the bottom plate 22. Consequently, each of the regions, illustrated by A in FIG. 3 and defined by the vertical walls 18, 21, the curved walls 19 and the bottom plate 20, is connected, on one hand, to the inside of the air cleaner (not shown) via the corresponding sector shaped opening 26 and, on the other hand, to the intake passage 7 (FIG. 1) via the corresponding sector shaped opening 23. Contrary to this, each of regions illustrated by B in FIG. 3 is closed by the lid member 14 and connected to only the intake passage 7 (FIG. 1) via the vacuum holes 24.

In operation, ambient air is sucked into the regions A via the sector shaped openings 26 of the lid member 14 and then introduced into the intake passage 7 (FIG. 1). At this time, since the flow of the sucked air is restricted by the rotatable controlling body 15, a vacuum is produced in the intake passage 7 (FIG. 1). In addition, since the regions B are connected to only the intake passage 7 (FIG. 1) via the vacuum holes 24 as mentioned above, a vacuum having the same pressure as that in the intake passage 7 (FIG. 1) is produced within the regions B. As mentioned previously, since the coil spring 17 provides an approximately constant torque to the controlling body 15 in spite of the position of the controlling body 15, the controlling body 15 rotates so that the pressure difference between the pressure in the regions A and the vacuum in the regions B is maintained at a constant value; that is, the flow velocity of the sucked air passing through the openings 23 of the bottom plate 22 is maintained at a constant level. As will be understood from FIG. 3, the cross-sectional area of the openings 23 is increased as the rotation angle of the controlling body 15 is increased so that the cross-sectional area of the opening 23 is directly proportional to the rotation angle of the controlling body 15. Consequently, since the flow velocity of the sucked air passing through the openings 23 is maintained at a constant level, the amount of the sucked air passing through the openings 23 is directly proportional to the cross-sectional area of the openings 23. Therefore, the rotation angle of the controlling body 15 is directly proportional to the amount of the sucked air fed into the intake passage 7 (FIG. 1).

Returning to FIG. 1, the fuel injection body 6 comprises a first constant pressure valve 27, a second constant pressure valve 28, a flow control valve 29 and a fuel injector 30. The first constant pressure valve 27 has a cover 27′ fixed onto the outer wall of the fuel injector body 6 together with a diaphragm 28′. In addition, the first constant pressure valve 27 has a constant pressure chamber 31 and an atmospheric pressure chamber 32 which are separated by the diaphragm 28′. The first return pipe 23 which is arranged to face a valve plate 34 mounted on the diaphragm 28′. The excess fuel return pipe 33 is connected to a fuel tank 35 via a fuel return passage 36 and a fuel return conduit 37. A conpression spring 38 is inserted into the atmospheric pressure chamber 32 for biasing the diaphragm 28′ towards the excess fuel return pipe 33, and the atmospheric pressure chamber 32 is connected to the atmosphere via the air hole 39. The constant pressure chamber 31 is connected, on one hand, to the fuel tank 35 via a fuel inlet 40, a fuel feed conduit 41, a fuel feed pump 42 driven by an electrical motor 43, and a fuel filter 44 and, on the other hand, to the flow control valve 29 via a fuel feed passage 45.

The second constant pressure valve 28 has a cover 46 fixed onto the outer wall of the fuel injector body 6 together with a diaphragm 47. In addition, the second constant pressure valve 28 has a constant pressure chamber 48 and an atmospheric pressure chamber 49 which are separated by the diaphragm 47. The second constant pressure valve 28 further comprises an excess fuel return pipe 50 which is arranged to face a valve plate 51 mounted on the diaphragm 47. The excess fuel return pipe 50 is connected to the fuel tank 35 via a fuel return passage 52, the fuel return passage 36, and the fuel return conduit 37. A compression spring 53, having a spring force which is smaller than that of the compression spring 38 of the first constant pressure valve 27, is inserted into the atmospheric pressure chamber 49 for biasing the diaphragm 47 towards the excess fuel return pipe 50, and the atmospheric pressure chamber 49 is connected to the atmosphere via the air hole 54. A fuel feed passage 55 branches off from the fuel feed passage 45 and is connected to the constant pressure chamber 48 of the second constant pressure valve 28. A fuel metering jet 56 is arranged in the fuel feed passage 55.

The fuel injector 30 has a fuel chamber 57 and a back pressure chamber 58 which are separated by a diaphragm 59. A fuel nozzle 60 is formed on the bottom wall of the fuel chamber 57. A movable needle 61 is supported by the diaphragm 59 and arranged to cooperate with the fuel nozzle 60. A compression spring 62 is inserted into the back pressure chamber 58 for biasing the diaphragm 59 towards the fuel nozzle 60. The back pressure chamber 58 is connected to the constant pressure chamber 48 of the second constant pressure valve 28 via a fuel feed passage 63, and the fuel chamber 57 is connected to the constant pressure chamber 31 of the first constant pressure valve 27 via a fuel feed passage 64, the flow control valve 29 and the fuel feed passage 45.

Figure 6:
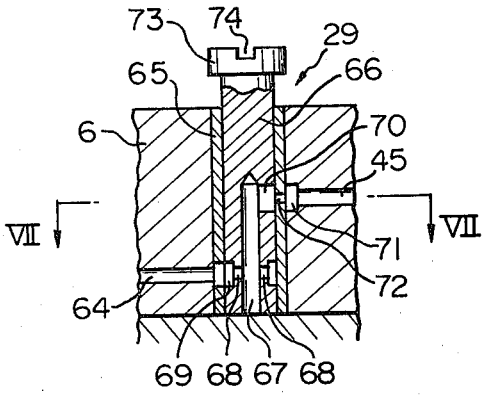
FIG. 6 is a cross-sectional side view of a flow control valve.
Figure 7:
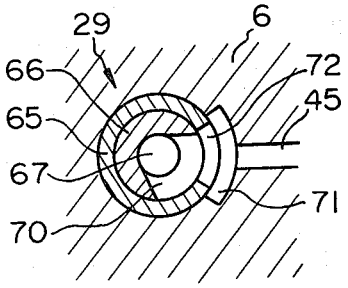
FIG. 7 is a cross-sectional view taken along the line VII—VII in FIG. 6.

As illustrated in FIGS. 6 and 7, the flow control valve 29 comprises a stationary hollow cylinder 65 arranged in the fuel injector body 6, and a metering rod 66 rotatably inserted into the hollow cylinder 65. The metering rod 66 has formed therein an axial bore 67, a plurality of radial bores 68 and an annular groove 69 and, thus, the axial bore 67 is connected to the fuel feed passage 64 via the radial bores 68 and the annular groove 69. The metering rod 66 further forms a cut away portion 70, and the upper end of the axial bore 67 opens into the cut away portion 70. A groove 71, extending along the outer wall of the hollow cylinder 65, is formed in the fuel injector body 6 and connected to the fuel feed passage 45. A metering slot 72 is formed in the hollow cylinder 65, and the groove 71 is connected to the cut away portion 70 via the metering slot 72. This slot 72 has a uniform width over the entire length thereof. As illustrated in FIG. 6, the metering rod 66 has at its top an enlarged head 73 having a diametrically extending groove 74. On the other hand, as illustrated in FIG. 4, the shaft 16 of the controlling body 15 has on its lower end an enlarged head 75 having a projection 76. As illustrated in FIG. 1, when the instrument 8 is assembled onto the fuel injector body 6, the projection 76 of the enlarged head 75 comes into engagement with the groove 74 of the enlarged head 73. Therefore, the metering rod 66 is caused to rotate together with the shaft 16. As hereinbefore described with reference to FIGS. 6 and 7, the metering slot 72 has a uniform width over the entire length thereof. Consequently, the cross-sectional area of the intersecting zone of the metering slot 72 and the cut away portion 70 is directly proportional to the rotation angle of the metering rod 66. On the other hand, as mentioned previously, the rotation angle of the controlling body 15 (FIG. 2) is directly proportional to the amount of the sucked air fed into the intake passage 7 (FIG. 1). Therefore, the cross-sectional area of the intersecting zone of the metering slot 72 and the cut away portion 70 is directly proportional to the amount of the sucked air.

In operation, the fuel is fed into the constant pressure chamber 31 from the fuel tank 35 by the fuel pump 42 as illustrated in FIG. 1. When the pressure of the fuel within the constant pressure chamber 31 is increased beyond a predetermined level, the valve plate 34 moves towards the right in FIG. 1 against the spring force of the compression spring 38 and opens the excess fuel return pipe 33 and, as a result, a part of the fuel within the constant pressure chamber 31 is returned to the fuel tank 35 via the excess fuel return pipe 33, the fuel return passage 36 and the fuel tank 35. Therefore, the pressure of the fuel within the constant pressure chamber 31 is maintained at a constant level. The fuel under pressure within the constant pressure chamber 31 is fed, on one hand, to the fuel chamber 57 of the fuel injector 30 via the fuel feed passage 45, the flow control valve 29 and the fuel feed passage 64 and, on the other hand, to the constant pressure chamber 48 of the second constant pressure valve 28 via the fuel feed passages 45 and 55 and the metering jet 56. In the second constant pressure valve 28, when the pressure within the constant pressure chamber 48 is increased beyond a predetermined level, the valve plate 51 moves towards the left in FIG. 1 against the spring force of the compression spring 53 and opens the excess fuel return pipe 50 and, as a result, a part of the fuel within the constant pressure chamber 48 is returned to the fuel tank 35 via the excess fuel return pipe 50 and the fuel return passages 52 and 36. Therefore, the pressure of the fuel within the constant pressure chamber 48 is maintained at a constant level and, thus, the pressure of the fuel within the back pressure chamber 58 is also maintained at a constant level. As mentioned previously, the compression spring 53 of the second constant pressure valve 28 is weaker than the compression spring 38 of the first constant pressure valve 27, that is, the constant pressure within the constant pressure chamber 48 is smaller than that within the constant pressure chamber 31 so that the force downwardly acting on the diaphragm 59, which force is caused by the spring force of the compression spring 62 and the pressure of the fuel within the back pressure chamber 58, becomes equal to the force upwardly acting on the diaphragm 59, which force is caused by the pressure of the fuel within the fuel chamber 57. Consequently, when the fuel feed pump 42 is operating, the fuel nozzle 60 remains opened as illustrated in FIG. 1. On the other hand, when the fuel pump 42 is stopped, the fuel nozzle 60 is closed by the needle 61 due to the spring force of the compression spring 62.

As mentioned previously, the cross-sectional area of the intersecting zone of the metering slot 72 and the cut away portion 70 (FIGS. 6 and 7) is directly proportion to the amount of the air sucked in. In addition, fuel having a constant pressure is fed into the fuel chamber 57 of the fuel injector 30 from the constant pressure chamber 31 of the first constant pressure valve 27 via the above-mentioned intersecting zone of the flow control valve 29. Consequently, the amount of the fuel injected from the fuel nozzle 60 into the intake passage 5 towards the throttle valve 9 is directly proportional to the amount of the air sucked in.

Figure 8:
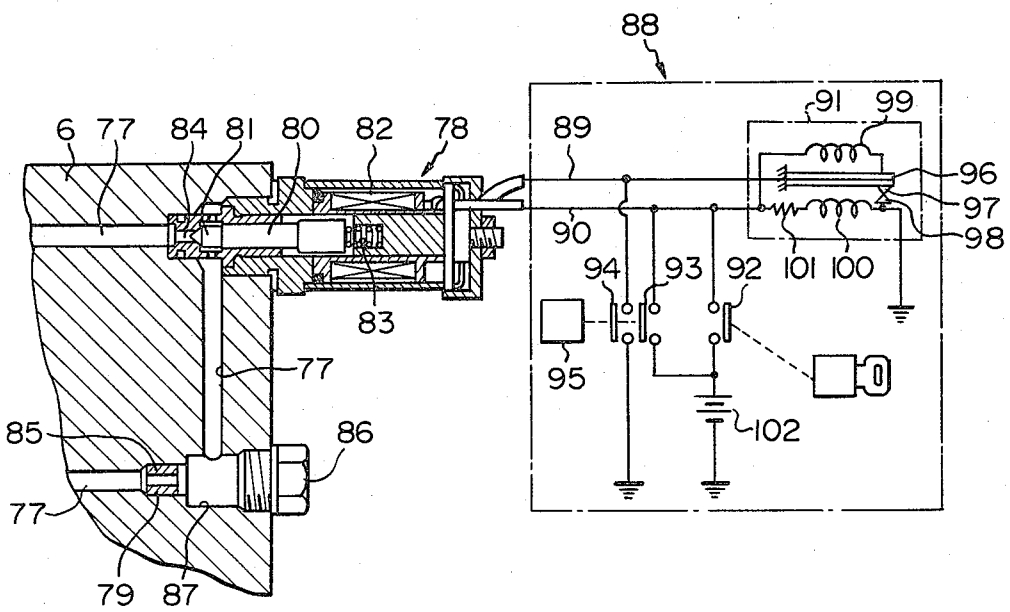
FIG. 8 is a cross-sectional side view of an electromagnetic valve and an electronic control circuit.

Referring to FIG. 1, a fuel bypass passage 77, directly interconnecting the constant pressure chamber 31 of the first constant pressure valve 27 to the fuel chamber 57 of the fuel injector 30 without being routed through the flow control valve 29, is formed in the fuel injector body 6. An electromagnetic valve 78 and a fuel metering jet 79, which are schematically depicted in FIG. 1, are arranged in the fuel bypass passage 77. Referring to FIG. 8, the electromagnetic valve 78 comprises a movable plunger 80 having a valve head 81, a solenoid 82, and a compression spring 83 for biasing the plunger 80 towards a valve port 84. When the solenoid 82 is deenergized, the valve head 81 closes the valve port 84, as illustrated in FIG. 8. On the other hand, when the solenoid 82 is energized, the plunger 80 moves towards the right in FIG. 8. As a result of this, the valve head 81 opens the valve port 84 and permits the flow of the fuel. In addition, the metering jet 79 is press-fitted or screwed into a reduced diameter hole 85 formed in the fuel injector body 6. A plug 86 is screwed into an increased diameter hole 87 formed in the fuel injector body 6 at a position adjacent to the reduced diameter hole 85.

As illustrated in FIG. 8, the solenoid 82 of the electromagnetic valve 78 is connected to an electronic control circuit 88 via leads 89, 90. The electronic control circuit 88 comprises a temperature reactive switch 91, an ignition switch 92, a first switch 93, a second switch 94, and an acceleration detector 95 for actuating the first switch 93 and the second switch 94 at the same time. The temperature reactive switch 91 comprises a bimetallic element 96 having a movable contact 97, a stationary contact 98, a pair of heaters 99 and 100, and a resistor 101. The lead 89 is connected to the bimetallic element 96 on one hand and grounded via the second switch 94 on the other hand. The lead 90 is connected to a power source 102 via the ignition switch 92 and the first switch 93 which are arranged in series. The stationary contact 98 is grounded on one hand and on the other hand connected to the lead 90 via the heater 100 and the resistor 101. In addition, the bimetallic element 96 is connected to the power source 102 via the ignition switch 92.

When the temperature of the engine is low, the movable contact 97 of the bimetallic element 96 is in contact with the stationary contact 98, as illustrated in FIG. 8. Consequently, when the ignition switch 92 is turned to the ON condition, electric current is fed into both the solenoid 82 and the heaters 99 and 100. As a result of this, the solenoid 82 is energized and, thus, the valve head 81 of the plunger 80 opens the valve port 84. Therefore, in FIG. 1, the fuel is fed into the fuel chamber 57 from the fuel bypass passage 77 via the electromagnetic valve 78 and the metering jet 79 in addition to the fuel fed into the fuel chamber 57 from the fuel feed passage 64 via the flow control valve 29. As a result of this, the amount of the fuel injected from the fuel nozzle 60 is increased when the temperature of the engine is low.

Turning to FIG. 8, when the bimetallic element 96 is flexed upwards due to the heat of the heaters 99 and 100 a little while after the engine is started, the electrical connection between the movable contact 97 and the stationary contact 98 is broken. As a result of this, the solenoid 82 is de-energized and, at the same time, the supply of electric current for the heater 99 is stopped. Consequently, the valve port 84 is closed by the valve head 81. Even if the electrical connection between the movable contact 97 and the stationary contact 98 is broken, electric current is fed into the heater 100. Consequently, since the bimetallic element 96 remains flexed upwards due to the heat of the heater 100, the electrical connection between the movable contact 97 and the stationary contact 98 remains broken. The bimetallic element 96 is flexed when the temperature thereof reaches a predetermined level. Consequently, it will be understood that the lower the temperature of the engine when the engine is started, the longer the time period during which the solenoid 82 is energized.

As illustrated in FIG. 1, the acceleration detector 95 has a first chamber 103 and a second chamber 104 which are separated by a diaphragm 105. A compression spring 106 is inserted into the second chamber 104, and the diaphragm 105 is operatively connected to both the first switch 93 and the second switch 94. The first and second chambers 103 and 104 are separated from a vacuum chamber 107 via a partition 108, and this vacuum chamber 107 is connected to the inside of the intake manifold 2 via a vacuum conduit 109. A restricted opening 110 and a check valve 111 only allowing the air flow from the vacuum chamber 107 into the first chamber 103 are arranged in the partition 108 separating the first chamber 103 from the vacuum chamber 107, and a restricted opening 112 is formed in the partition 108 separating the second chamber 104 from the vacuum chamber 107.

When the engine is operating under a light load and, thus, the throttle valve 9 is opened only to a small degree as illustrated in FIG. 1, a great vacuum is produced within the intake manifold 2, and the same great vacuum is produced within the vacuum chamber 107, the first chamber 103 and the second chamber 104. At this time, the first switch 93 and the second switch 94 are in the OFF condition. When the throttle valve 9 is abruptly opened for accelerating the engine, the level of the vacuum produced within the intake manifold 2 and the vacuum chamber 107 becomes small. At this time, since the check valve 111 opens, the level of the vacuum produced in the first chamber 103 also becomes small. As a result of this, the diaphragm 105 moves towards the right in FIG. 1 against the spring force of the compression spring 106 and, thereby, the first switch 93 and the second switch 94 are turned to the ON condition. As it will be understood from FIG. 8, when the first switch 93 and the second switch 94 are turned to the ON condition, the solenoid 82 is energized. As a result of this, in FIG. 1, the fuel is fed into the fuel chamber 57 from the fuel bypass passage 77 and, thus, the amount of the fuel injected from the fuel nozzle 60 is increased. After the level of the vacuum produced in the vacuum chamber 107 abruptly becomes small, the air within the vacuum chamber 107 gradually flows into the second chamber 104 via the restricted opening 112. Consequently, since the level of the vacuum produced in the second chamber 104 becomes small a little while after the throttle valve 9 is abruptly opened, the diaphragm 105 moves towards the left in FIG. 1. As a result of this, the first switch 93 and the second switch 94 are turned to the OFF condition and, thus, the electromagnetic valve 78 is de-energized.

Figure 9:
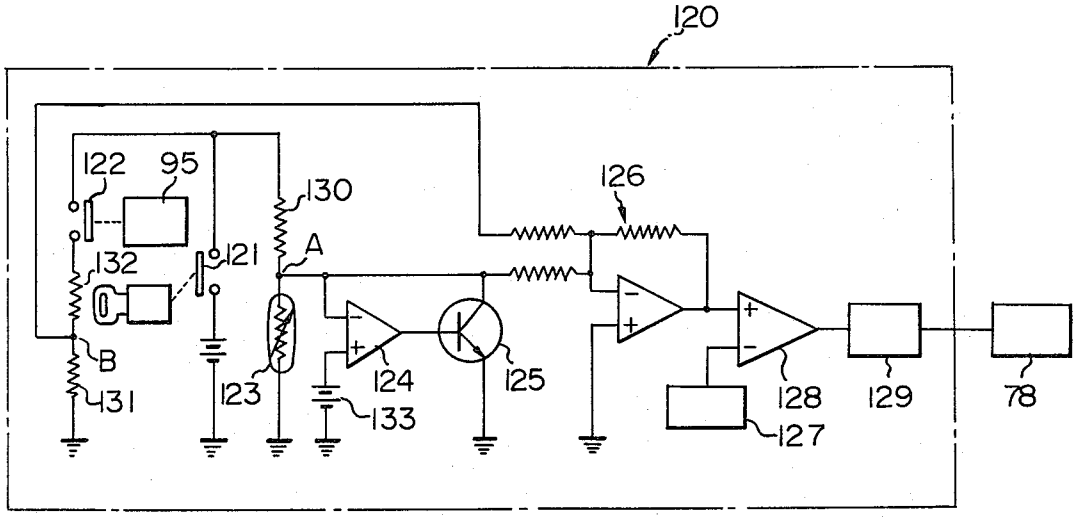
FIG. 9 is a modification of the electronic control circuit illustrated in FIG. 8.
Figure 10:
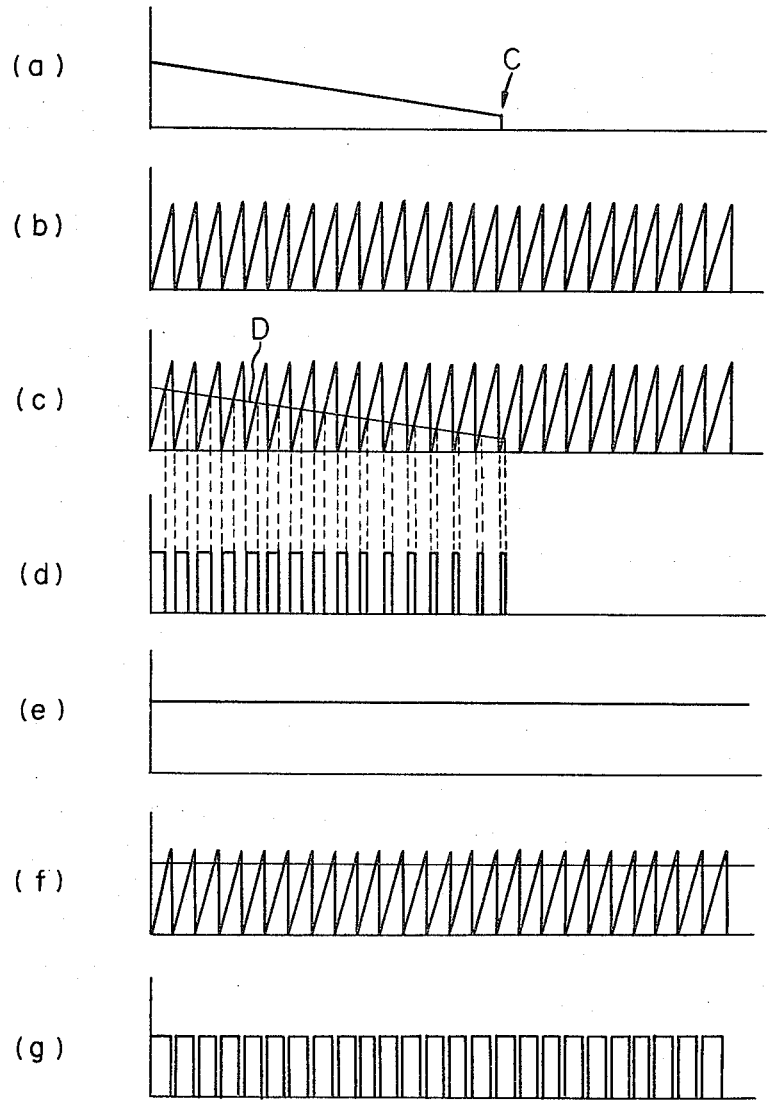
FIG. 10 is a diagram showing changes in voltage.

FIG. 9 illustrates a modification of the electric control circuit 88 illustrated in FIG. 8. Referring to FIG. 9, an electric control circuit comprises an ignition switch 121, an acceleration switch 122 actuated by the acceleration detector 95 (FIG. 1), a thermistor 123, a first comparator 124, a transistor 125, an adder circuit 126, a saw tooth shaped wave generator 127, a second comparator 128 and an amplifier 129. When the ignition switch 121 is turned to the ON condition, the voltage level at the point A is raised. This voltage level at the point A is determined by a ratio of the resistance valve of the thermistor 123 to the resistance valve of a resistor 130. The thermistor 123 is arranged, for example, in the engine body 1 (FIG. 1) and, thus, the resistance valve of the thermistor 123 is reduced as the temperature of the engine body 1 (FIG. 1) is increased. Consequently, the voltage level at the point A is decreased as the temperature of the engine body 1 (FIG. 1) is increased. In addition, when the acceleration switch 122 is turned to the ON condition, the voltage level at the point B is raised to a predetermined fixed level which is determined by a ratio of the resistance valve of a resistor 131 to the resistance valve of a resistor 132. The voltage at the point A is applied to one input of the adder circuit 126, and the voltage at the point B is applied to the other input of the adder circuit 126. In addition, the point A is connected, on one hand, to the inverting input of the first comparator 124 and, on the other hand, to the collector of the transistor 125. The non-inventing input of the first comparator 124 is grounded via a reference voltage source 133. The output of the first comparator 124 is connected to the base of the transistor 125, and the emitter of the transistor 125 is grounded. As the time passes after the engine is started, the temperature of the engine body 1 (FIG. 1) is gradually increased. Consequently, as the time passes, the voltage level at the point A is gradually decreased as illustrated in FIG. 10(a). When the voltage level at the point A is decreased below the level of the reference voltage source 133, the output voltage of the first comparator 124 is turned to a high level from a low level. As a result of this, the transistor 125 is turned to the saturating state from the cut off state and, thus, the voltage level at the point A is instantaneously decreased to a level which is almost the same as the ground level, as illustrated by the point C in FIG. 10(a).

The voltage at the point A and the voltage at the point B are added in the adder circuit 126. Consequently, assuming that the acceleration switch 122 is in the OFF condition, since the voltage level at the point B becomes equal to the ground level, the output voltage of the adder circuit 126 becomes equal to the voltage at the point A. This output voltage of the adder circuit 126 is applied to the non-inverting input of the second comparator 128. The inverting input of the second comparator 128 is connected to the saw tooth shaped wave generator 127 which produces a saw tooth shaped wave, as illustrated in FIG. 10(b). The output voltage of the adder circuit 126 and the output voltage of the saw tooth shaped wave generator 127 are compared in the second comparator 128, as illustrated in FIG. 10(c). Since this second comparator 128 produces an output voltage when the output voltage of the adder circuit 126 is higher than that of the saw tooth shaped wave generator 127, the second comparator 128 produces a train of pulses, as illustrated in FIG. 10(d). From FIGS. 10(a) and (b), it will be understood that, as the output voltage D of the adder circuit 126 is reduced, the width of the pulse is reduced, that is, the duty cycle of the pulse is reduced. The output of the second comparator 128 is amplified in the amplifier 129 and then fed into the solenoid 82 of the electromagnetic valve 78 (FIG. 8). In FIG. 8, the flow area formed between the valve head 81 and its valve seat is reduced as the width of the pulse fed into the solenoid 82 of the electromagnetic valve 78 is reduced. On the other hand, as will be understood from the above description, as the temperature of the engine body 1 (FIG. 1) is increased, the width of the pulse fed into the solenoid 82 of the electromagnetic valve 78 is reduced. Consequently, as the temperature of the engine body 1 (FIG. 1) is increased, the flow area formed between the valve head 81 and its valve seat is reduced. Therefore, in FIG. 1, as the temperature of the engine body 1 is increased, the amount of the fuel fed into the fuel chamber 57 from the fuel bypass passage 77 is reduced.

In FIG. 9, when the voltage level at the point A is decreased below the level of the reference voltage source 133, that is, when the warm-up of the engine is completed, the voltage level at the point A is decreased to a level which is almost the same as the ground level as mention previously. On the other hand, when the acceleration switch 122 is turned to the ON condition, the voltage level at the point B is raised to a constant level, as illustrated in FIG. 10(e). In addition, the acceleration switch 122 is turned to the ON condition when the engine is accelerated. Consequently, when the engine is accelerated after the completion of warm-up of the engine, the output voltage of the adder circuit 126 becomes equal to the voltage at the point B. The output voltage of the adder circuit 126 and the output voltage of the saw tooth shaped wave generator 127 are compared in the second comparator 128, as illustrated in FIG. 10(f). Since the output voltage of the adder circuit 126 is maintained at a constant level, the second comparator 128 produces a train of pulses each having a uniform width, as illustrated in FIG. 10(g). Therefore, in FIG. 1, when the engine is accelerated, the electromagnetic valve 78 is energized and, thus, the fuel is fed into the fuel chamber 57 from the fuel bypass passage 77.

Returning to FIG. 9, when the temperature of the engine is low, the voltage level at the point A is raised to a level illustrated in FIG. 10(a). At this time, if the engine is accelerated, the voltage level at the point B is raised to a constant level, illustrated in FIG. 10(e). Consequently, at this time, since the voltage at the point A and the voltage at the point B are added in the adder circuit 126, the adder circuit 126 produces an output voltage which is greater than the peak of the output voltage of the saw tooth shaped wave generator 127. Therefore, when the engine is accelerated before completion of the warm-up of the engine, the valve port 84 of the electromagnetic valve 78 (FIG. 8) is fully opened.

According to the present invention, the amount of the fuel fed into the cylinders of an engine is increased at the time of acceleration and before completion of the warm-up of an engine. Consequently, good combustion can be always ensured. In addition, an increase in the amount, of the fuel, which is necessary to ensure good combustion at the time of acceleration and before completion of the warm-up of an engine, is different between engines. However, in the present invention, an increase in the amount of the fuel fed from the fuel injector can be easily adjusted to an optimum amount by merely changing the size of the metering jet 79 (FIG. 8). Furthermore, in the present invention, since the fuel bypass passage 77, the electromagnetic valve 78 and the metering jet 79 (FIG. 1) are integrally assembled into the fuel injector body 6, the fuel injection device according to the present invention has an extremely simple construction.

While the invention has been described by reference to specific embodiments chosen for purposes of illustration, it should be apparent that numerous modifications could be made thereto by those skilled in the art without departing from the spirit and scope of the invention.

We claim:

1. A fuel injection device of an internal combustion engine having an intake passage, said device comprising:

a fuel reservoir;

a fuel pump connected to said fuel reservoir;

a fuel chamber having a fuel nozzle which opens into said intake passage;

a fuel feed passage connecting said fuel pump to said fuel chamber;

flow control means arranged in said fuel feed passage for controlling the flow of a fuel to feed the fuel into said fuel chamber in an amount which is directly proportional to the amount of sucked air flowing within said intake passage;

first valve means having a constant pressure chamber arranged in said intake passage between said fuel pump and said flow control means for feeding the fuel at a constant pressure into said flow control means;

detecting means for detecting an operating condition of the engine to produce a control signal when the engine is accelerated and before the completion of warm-up of the engine;

a fuel bypass passage directly connecting said constant pressure chamber to said fuel chamber, and;

normally closed second valve means arranged in said fuel bypass passage for opening said fuel bypass passage in response to said control signal when the engine is accelerated and before the completion of warm-up of the engine.

2. A fuel injection device as claimed in claim 1, wherein said device comprises a fuel injector body arranged in said intake passage, said fuel chamber and said fuel bypass passage being arranged in said fuel injector body, said second valve means being integrally assembled into said fuel injector body.

3. A fuel injection device as claimed in claim 2, wherein a metering jet is arranged in said fuel bypass passage.

4. A fuel injection device as claimed in claim 1, wherein said detecting means comprises a vacuum operated switch for detecting the acceleration of the engine, and a temperature reactive apparatus for detecting whether the warm-up of the engine is completed, said second valve means comprising an electromagnetic valve actuated in response to said control signals derived from said vacuum operated switch and said temperature reactive apparatus.

5. A fuel injection device as claimed in claim 4, wherein said vacuum operated switch has a first chamber and a second chamber which are separated by a spring loaded diaphragm, said first chamber being connected to said intake passage via a check valve and a restricted opening, said second chamber being connected to said intake passage via a restricted opening.

6. A fuel injection device as claimed in claim 4, wherein said temperature reactive apparatus comprises a bimetallic element, and a heater for heating said bimetallic element, said control signal being issued when said bimetallic element is flexed due to the heat of said heater.

7. A fuel injection device as claimed in claim 4, wherein said temperature reactive apparatus comprises a thermistor arranged in said engine, a saw tooth shaped wave generator and a comparator for comparing the voltage level at one end of said thermistor with the voltage level of the output of said saw tooth shaped wave generator to produce said control signal in the form of continuous pulses.

8. A fuel injection device as claimed in claim 1, wherein said device further comprises a back pressure chamber separated from said fuel chamber via a diaphragm having a needle, a compression spring being arranged in said back pressure chamber for biasing said needle towards said fuel nozzle.

9. A fuel injection device as claimed in claim 8, wherein said device further comprises third valve means having a constant pressure chamber which is arranged in a fuel passage connecting said constant pressure chamber of said first valve means to said back pressure chamber for reducing a constant pressure within said back pressure chamber as compared with a constant pressure within said constant pressure chamber of said first valve means.

10. A fuel injection device as claimed in claim 1, wherein said flow control means comprises a flow control valve arranged in said fuel feed passage, and a controlling apparatus arranged in said intake passage and directly connected to said flow control valve for driving said flow control valve.

11. A fuel injection device as claimed in claim 10, wherein said flow control valve comprises a hollow cylinder forming a slot thereon, and a rotatable metering rod having a cut away portion and directly connected to said controlling apparatus, the amount of the fuel fed into said fuel chamber being increased in accordance with an increase in the cross-sectional area of the intersecting zone of said slot and said cut away portion.

12. A fuel injection device as claimed in claim 10, wherein said controlling apparatus comprises a stationary cylindrical casing, and a spring loaded controlling body rotatably arranged in the cylindrical casing and directly connected to said flow control valve, the rotation angle of said controlling body being directly proportional to the amount of the air sucked in.

13. A fuel injection device as claimed in claim 12, wherein said cylindrical casing comprises a radially inwardly extending vertical wall and a bottom plate forming thereon an air flow opening, said controlling body comprising a radially outwardly extending vertical wall and a bottom plate for controlling the cross-sectional area of said air flow opening, one of the spaces enclosed by said cylindrical casing and the vertical walls of said cylindrical casing and said controlling body forming a sucked air flow passage, the other space forming a vacuum chamber connected to said intake passage located downstream of said controlling apparatus.

14. A fuel injection device as claimed in claim 1, wherein said engine further comprises a throttle valve arranged in said intake passage, said fuel nozzle being arranged upstream of said throttle valve and directed to said throttle valve.

* * * * *